US006374943B1

(12) United States Patent
Choi

(10) Patent No.: US 6,374,943 B1
(45) Date of Patent: Apr. 23, 2002

(54) BAFFLE PLATE OF DISCHARGE MUFFLER FOR HERMETIC RECIPROCATING COMPRESSOR

(75) Inventor: Jin-Kyu Choi, Suwon (KR)

(73) Assignee: Samsung Kwangju Electronics Co., Ltd. (KR)

( * ) Notice: Subject to any disclaimer, the term of this patent is extended or adjusted under 35 U.S.C. 154(b) by 0 days.

(21) Appl. No.: 09/604,671

(22) Filed: Jun. 27, 2000

(30) Foreign Application Priority Data

Dec. 20, 1999 (KR) ..... 99/59479

(51) Int. Cl.[7] ..... F02M 35/00
(52) U.S. Cl. ..... 181/229; 181/403
(58) Field of Search ..... 181/229, 403; 417/312, 902

(56) References Cited

U.S. PATENT DOCUMENTS 3,811,251 A * 5/1974 Gibel
5,196,654 A * 3/1993 Di Flora et al.
6,257,842 B1 * 7/2001 Kawasaki et al. ..... 417/312

FOREIGN PATENT DOCUMENTS

JP 409151869 * 6/1997

* cited by examiner

*Primary Examiner*—Shih-Yung Hsieh
(74) *Attorney, Agent, or Firm*—Burns, Doane, Swecker & Mathis, L.L.P.

(57) ABSTRACT

There is provided a baffle plate of a discharge muffler for a hermetic reciprocating compressor which is mounted in an inner portion of the discharge muffler mounted at a lower portion of a cylinder block so as to reduce flow noise of a refrigerant discharged to a discharge pipe, characterized in that an extended duct, which is communicated from a center portion of the baffle plate to the discharge pipe and has a diameter, is formed during a press molding. The extended duct is formed to be directed to the cover from the baffle plate by a burring process during a press molding, thereby improving the noise excluding efficiency.

2 Claims, 6 Drawing Sheets

BAFFLE PLATE OF DISCHARGE MUFFLER FOR HERMETIC RECIPROCATING COMPRESSOR

This application claims priority under 35 U.S.C. §§119 and/or 365 to 59479/1999 filed in Korea on Dec. 20. 1999 ; the entire content of which is hereby incorporated by reference.

BACKGROUND OF THE INVENTION

1. Field of the Invention

The present invention relates to a hermetic reciprocating compressor, more particularly, a baffle plate of a discharge muffler for a hermetic reciprocating compressor, which reduces flow noise generated by high pressure refrigerant which is discharged through a discharge chamber of a cylinder head into the discharge muffler.

2. Description of the Related Art

Generally, a hermetic reciprocating compressor is operated to compress a refrigerant at a high pressure and a high temperature through a refrigerating cycle and discharge the refrigerant out of a housing of the hermetic reciprocating compressor. In the refrigerating cycle, the refrigerant is sequentially compressed, condensed, expanded and evaporated.

As shown in FIGS. 4–6, a conventional hermetic reciprocating compressor comprises a sealed housing 10 which is divided into an upper housing 11 and a lower housing 12, a driving part 20 which is disposed in the sealed housing 10 and a compressing part 30 which receives a driving force from the driving part 20 so as to suck and compress a refrigerant.

The driving part 20 is disposed at an upper portion of the sealed housing 10 and is provided with a stator 21 which is fixed to a cylinder block 32 in the lower housing 12, a rotor (not shown) which generates a magnetic field and a rotational shaft 22 which is rotatably coupled to the rotor and is integrally formed with an eccentric shaft 23 at a lower portion thereof.

In addition, the compressing part 30 is mounted at the lower housing 12 and comprises a cylinder head 31 which is formed with a suction chamber (not shown) and a discharge chamber (not shown) for guiding the refrigerant which is sucked and discharged, the cylinder block 32 which a compressing chamber (not shown) is provided therein, a piston (not shown) which is reciprocated in the compressing chamber and a connecting rod 33 which connects the piston with the eccentric shaft 23 and converts a rotational motion into a rectilinear motion.

On an upper portion of the cylinder head 31, there is provided a suction muffler 40 in which an inlet port 41 is formed. The inlet port 41 guides the refrigerant to the cylinder head 31 and excludes a noise which is generated upon refrigerant introduction. The suction muffler 40 is connected with a refrigerant guiding pipe 50 which guides the refrigerant introduction from an external portion of the sealed housing 10.

Meanwhile, on both ends of the cylinder block 32, there are respectively provided discharge mufflers 80 each of which is communicated through a communicating aperture 60 with the discharge chamber of the cylinder head 31. The discharge muffler 80 is served as a noise excluding device which reduces a flow noise due to the discharging of the high pressure refrigerant.

In such hermetic reciprocating compressor, when power source is applied, the compressing part 30 and the driving part 20 are operated.

That is, the stator 21 and the rotor are reciprocally acted so that the rotational shaft 22 is rotated along with the rotor. The piston, which is connected through the connecting rod 33 with the eccentric shaft 22 of the rotational shaft, is reciprocated in the compressing chamber. The refrigerant is sucked through the suction muffler 40 and the suction chamber of the cylinder head 31, and compressed at a high pressure, and then discharged through the discharge chamber of the cylinder head 31 and the communicating aperture 60 to the discharge muffler 80.

In the discharging process of the refrigerant, when the piston is moved to a bottom dead point, the refrigerant is sucked at a low pressure. And when the piston is moved to an upper dead point, the refrigerant is compressed at a high temperature and sequentially discharged to the discharge chamber of the cylinder head 31.

Then, the refrigerant is discharged through the communicating aperture 60 to the discharge muffler 80. Eventually, the compressed refrigerant is discharged from the muffler 80 through a discharge pipe 86 communicated with an inner portion of the discharge muffler 80 to the outside of the sealed housing 10.

The discharge muffler 80 temporarily stores the high pressure refrigerant so as to reduce the discharge noise, as shown in FIGS. 4 to 6. That is, on each end of the cylinder block 32, there is provided an installing part 70 on which the discharge muffler 80 is mounted. An aperture 71 having a thread therein is formed at a center portion of the installing part 70.

And, the discharge muffler 80 is coupled to the installing part 70. The discharge muffler 80 includes a hemispherical cover 81 which is coupled to the installing part 70 so as to form an inner space and a hemispherical baffle plate 82 which divides the inner space into an upper part and a lower space. The baffle plate 82 is recessed downward.

In addition, on each upper and lower part of an outer circumference, there is provided a gasket 83 for preventing a leakage of the refrigerant. The baffle plate 82 and the cover 81 are respectively formed with a bolt hole 84, 85 at center portion thereof.

Therefore, the upper space of the discharge muffler 80 is communicated through the communicating aperture 60 with the discharge chamber of the cylinder head 31 so that the high pressure refrigerant is introduced. The refrigerant is then introduced through the bolt hole 84 of the baffle plate 82 into the lower space of the discharge muffler 80 so as to be temporarily stored therein.

And, the discharge pipe 86 for guiding the high pressure refrigerant to the outside of the sealed housing 10 is connected with the cover 81.

The installing order of the discharge muffler 80 will be described more fully. First, the hemispherical baffle plate 82 having the upper and lower gaskets 83 is fitted with the hemispherical cover 81 of the discharge muffler 80. The cover 81 and baffle plate 82 are fixed to the cylinder block 32 by a bolt 90 provided with a washer 91 which is screwed through the bolt holes 84, 85.

Therefore, the discharge muffler 80 is formed with the inner space between the installing part 70 of the cylinder block 32 and the cover 81. Further, the inner space is divided into the upper space and the lower space by the baffle plate 82. Thus, when the high pressure refrigerant is discharged through the communication aperture 60 from the discharge chamber, the flow noise due to a different of flow speed of the refrigerant is reduced in the muffler. Then, the refrigerant is discharged through the discharge pipe 86 connected with a lower portion of the cover 81 to the outside.

However, since the inner space of the discharge muffler 80 is simply partitioned into the upper and lower spaces, there is a limit to the reducing of the noise which is generated when the high pressure and the high temperature refrigerant is discharged. Therefore, there is a problem that the vibration and noise by the high pressure refrigerant is directly transmitted to a refrigerating cycle.

SUMMARY OF THE INVENTION

It is therefore an object of the present invention to provide a baffle plate of a discharge muffler for a hermetic reciprocating compressor, which is provided with a duct extended to the cover at a center of a baffle plate thereof so as to increase a reducing efficiency of flow noise.

To achieve the above objects and other advantages, there is provided a baffle plate of a discharge muffler for a hermetic reciprocating compressor which is mounted in an inner portion of the discharge muffler mounted at a lower portion of a cylinder block so as to reduce flow noise of a refrigerant discharged to a discharge pipe, characterized in that an extended duct, which is communicated from a center portion of the baffle plate to the discharge pipe and has a diameter, is formed during a press molding.

BRIEF DESCRIPTION OF THE DRAWINGS

The above object and other advantages of the present invention will become more apparent by describing in detail the preferred embodiments thereof with reference to the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown.

Figure 1:
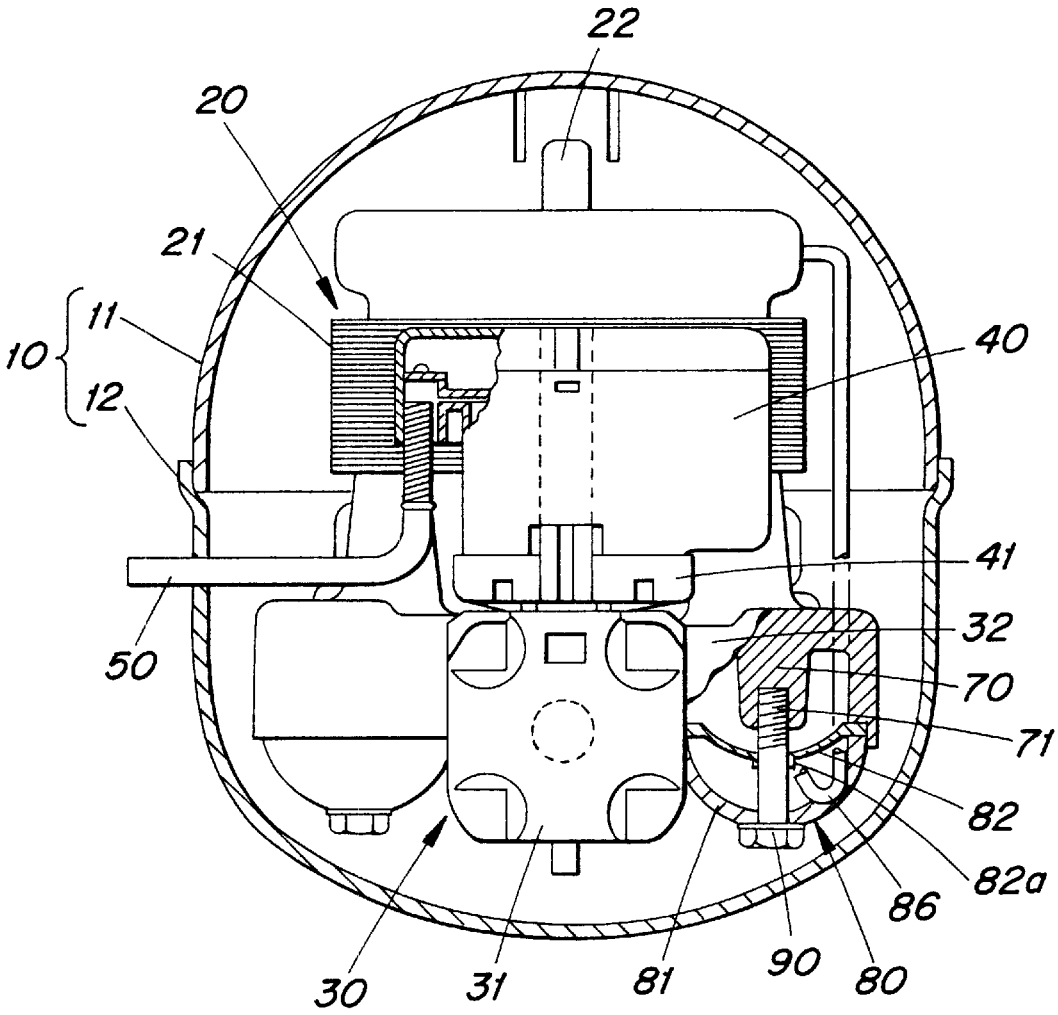
FIG. 1 is a schematic cross-sectional view showing an inner structure of a hermetic reciprocating compressor according to the present invention.
Figure 2:
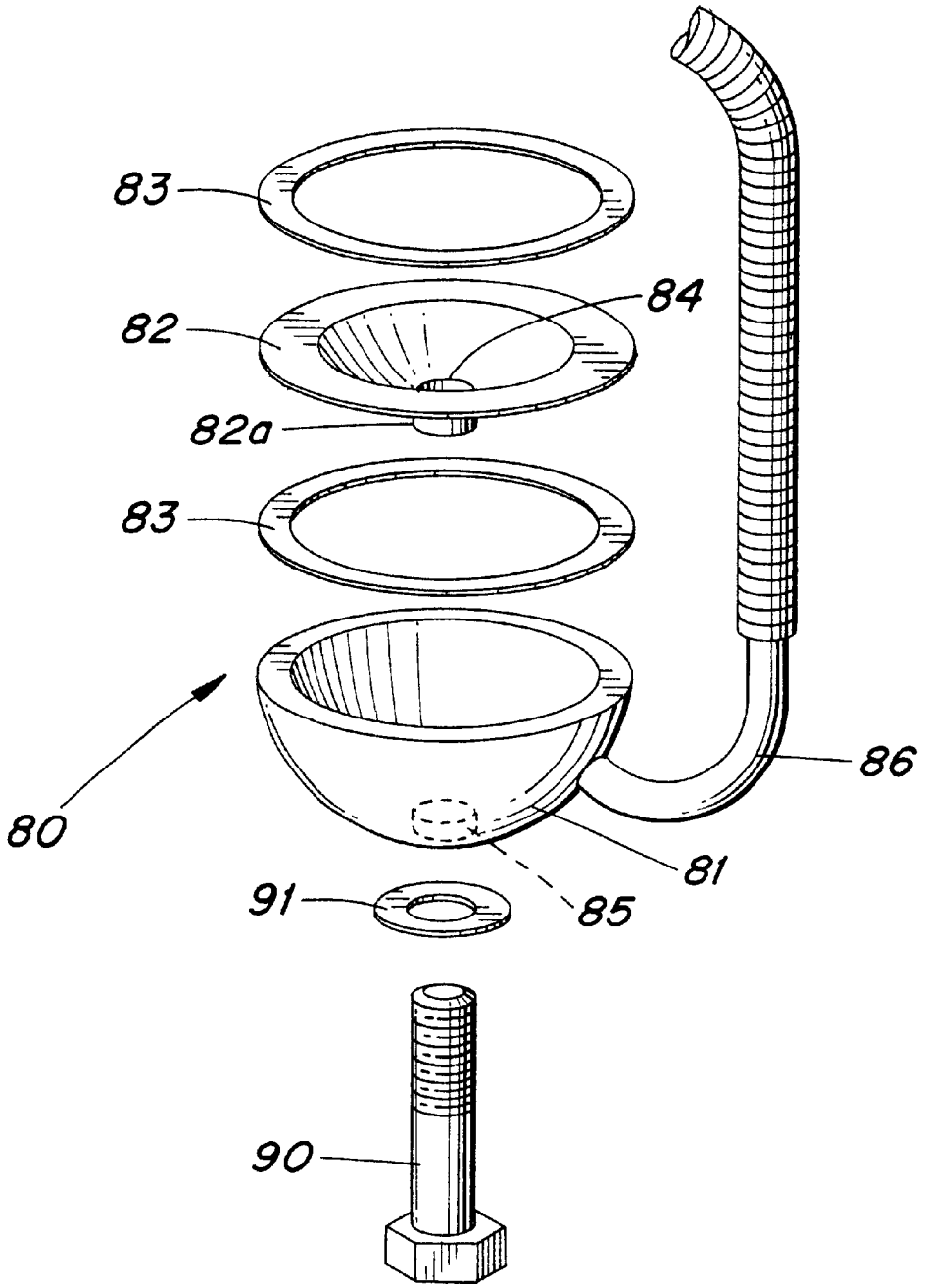
FIG. 2 is a schematic exploded perspective view of a discharge muffler according to the present invention.
Figure 3:
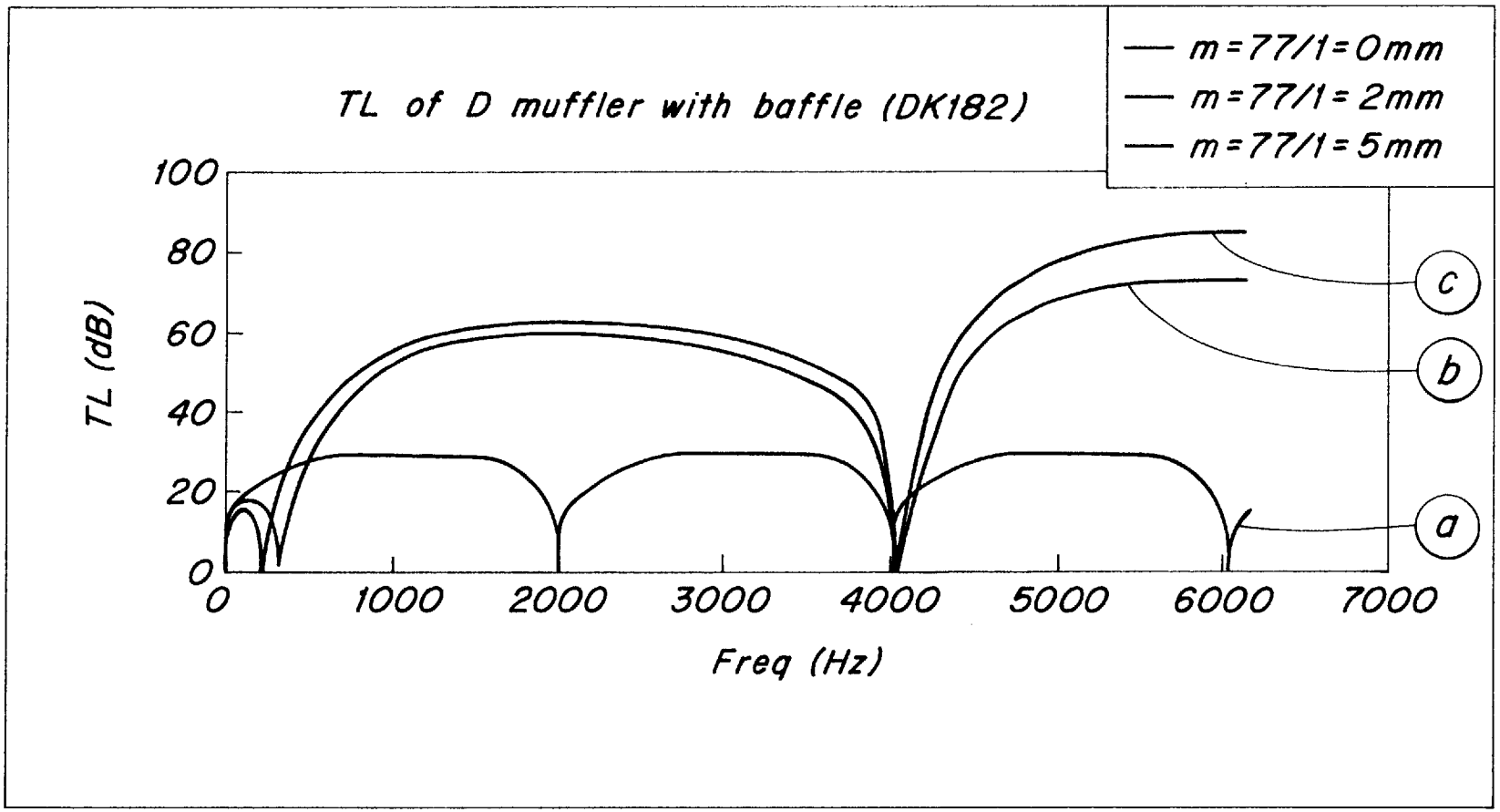
FIG. 3 is a graph showing a noise excluding degree according to a length of a extended duct of a baffle plate.
Figure 4:
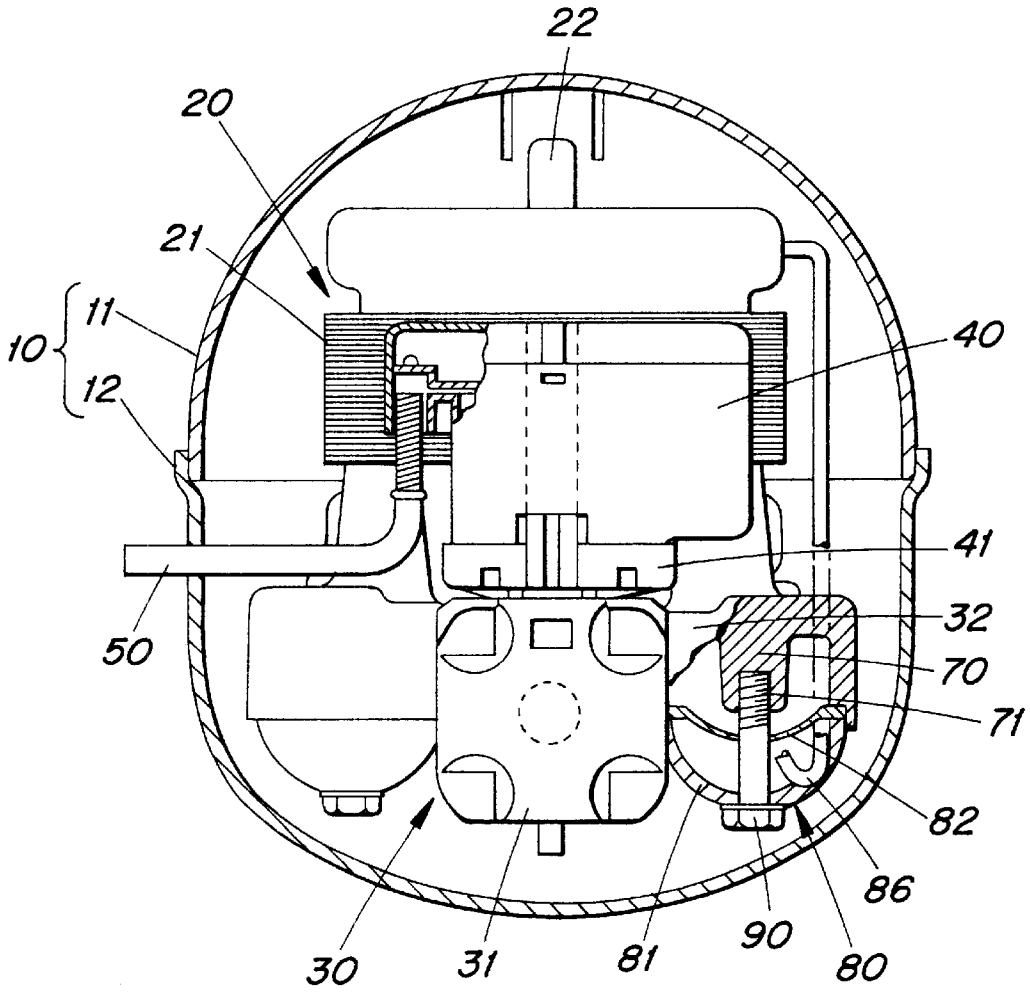
Fig. 4 PRIOR ART
FIG. 4 is a schematic cross-sectional view showing an inner structure of a conventional hermetic reciprocating compressor.
Figure 5:
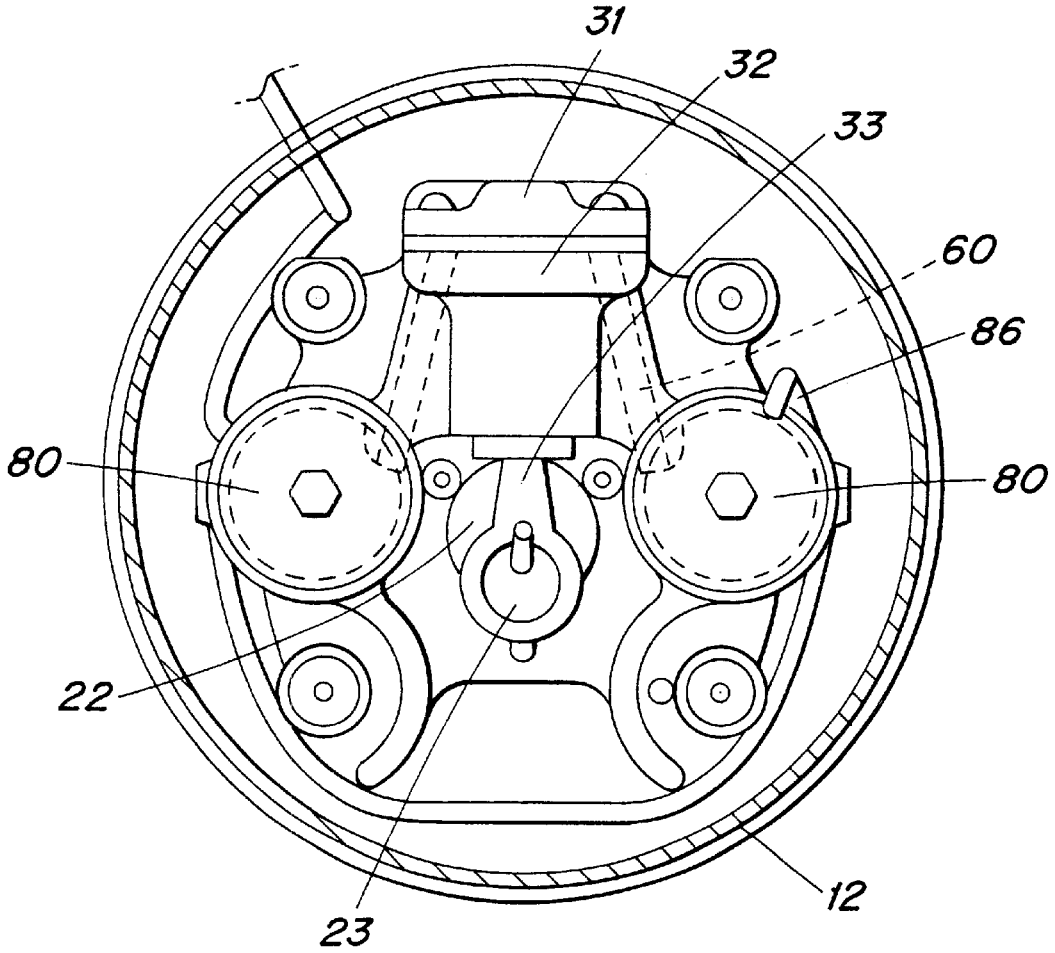
Fig. 5 PRIOR ART
FIG. 5 is a bottom view of the conventional hermetic reciprocating compressor.
Figure 6:
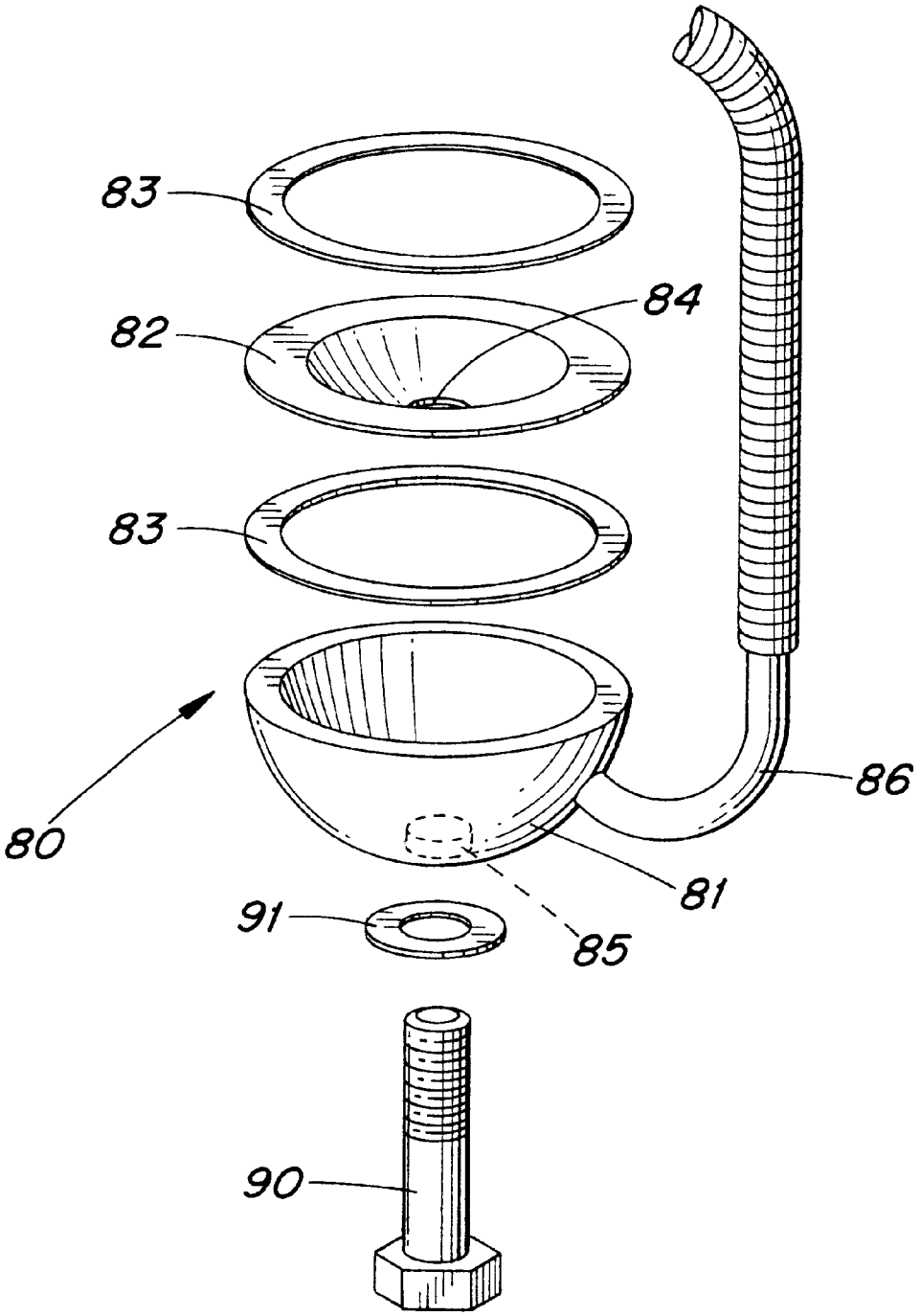
Fig. 6 PRIOR ART
FIG. 6 is a schematic exploded perspective view of a discharge muffler according to the prior art.

FIG. 1 is a schematic cross-sectional view showing an inner structure of a hermetic reciprocating compressor according to the present invention, FIG. 2 is a schematic exploded perspective view of a discharge muffler according to the present invention and FIG. 3 is a graph showing a noise excluding degree according to a length of a extended duct of a baffle plate.

According to the present invention, as shown in FIGS. 1 and 2, on each end of a cylinder block 32, there is provided an installing part 70 on which a discharge muffler 80 is mounted. And on a center portion of the installing part 70, there is formed a aperture 71 having a thread.

And, the discharge muffler 80 is coupled to the installing part 70. The discharge muffler 80 includes a hemispherical cover 81 which is coupled to the installing part 70 so as to form an inner space and a hemispherical baffle plate 82 which divides the inner space into an upper part and a lower space. The baffle plate 82 is recessed downward.

Here, there is formed a hole 84 at a center of baffle plate 82. An extended duct 82*a* is formed downward from the hole 84 by a burring process during a press molding.

In addition, on each upper and lower part of an outer circumference, there is provided a gasket 83 for preventing a leakage of refrigerant. The baffle plate 82 and the cover 81 are respectively formed with a bolt hole 84, 85 at a center portion thereof.

Therefore, the upper space of the discharge muffler 80 is communicated through the communicating aperture 60 with the discharge chamber of the cylinder head 31 so that the high pressure refrigerant is introduced. The refrigerant is then introduced through the bolt hole 84 of the baffle plate 82 into the lower space of the discharge muffler 80 and through a passage formed between an inner surface of the duct 82*a* and an outer surface of the bolt so as to be temporarily stored therein.

And, the discharge pipe 86 for guiding the high pressure refrigerant to the outside of the sealed housing 10 is connected with the cover 81.

The installing order of the discharge muffler 80 will be described more fully. First, the hemispherical baffle plate 82 having the upper and lower gaskets 83 is fitted with the hemispherical cover 81 of the discharge muffler 80. The cover 81 and baffle plate 82 are fixed to the cylinder block 32 by a bolt 90 provided with a washer 91 which is screwed through the bolt holes 84, 85.

Therefore, the discharge muffler 80 is formed with the inner space between the installing part 70 of the cylinder block 32 and the cover 81. Further, the inner space is divided into the upper space and the lower space by the baffle plate 82 having the extended duct 82*a*. Thus, when the high pressure refrigerant is discharged through the communication aperture 60 from the discharge chamber, the flow noise due to a difference of flow speed of the refrigerant is reduced by the extended duct 82*a*. Three, the refrigerant is discharged through the discharge pipe 86 connected with a lower portion of the cover 81 to the outside.

In FIG. 3, a line a indicates the noise excluding state without the extended duct, b indicates the noise excluding state with the extended duct of 2 mm and c indicates the noise excluding state with the extended duct of 5 mm. According to the above graph, the noise is excluded most preferably in case of the extended duct 82*a* in a length of ~5 mm.

According to an experimental value in connection with the length of the extended duct 82*a* and the noise excluding rate, it is preferable that the extended duct has a length of 3 mm considering a material and a manufacturing efficiency thereof.

The measuring result of the noise in the discharge muffler 80 with or without the extended duct of 3 mm is provided as follows:

TABLE 1

| Material | Measuring result (without extended duct) Noise value (Over All) | Peak value (kHz/dB) | Measuring result (with extended duct of 3 mm) Noise value (Over All) | Peak value (kHz/dB) |
|---|---|---|---|---|
| #1 | 50 | 2.688/39.97 | 49 | 2.528/37.91 |
| #2 | 51 | 5.136/39.45 | 50 | 3.024/36.99 |
| #3 | 53 | 3.424/48.41 | 49 | 3.36/39.19 |
| Average | 51.3 | | 49.3 | |

That is, as a measuring result of the noise in the discharge muffler 80 with or without the extended duct of 3 mm, the average noise level is reduced by 2 dB and he peak value is also reduced.

According to a principle of an expanding type inter connected muffler, the conventional muffler is not provided with the extended duct 82*a,* but in the discharge muffler according to the present invention, since the extended duct 82*a* can be applied to the discharge muffler without a separate duct forming process, it is not necessary to provide a separate equipment. Therefore, the manufacturing cost is not increased much.

According to the present invention, the extended duct 82*a* is formed to be directed to the cover from the baffle plate by a burring process during a press molding, thereby improving the noise excluding efficiency.

It will be apparent to those skilled in the art that various modifications and variations of the present invention can be made without departing from the spirit or scope of the invention. Thus, it is intended that the present invention cover the modifications and variations of this invention provided they come within the scope of the appended claims and their equivalents.

What is claimed is:

1. A discharge muffler for reducing noise of flowing refrigerant in a hermetic reciprocating compressor, comprising an installing part and a cover attached to the installing part by a bolt, the installing part and the cover forming an inner space, the inner space divided into first and second portions by a baffle plate, the first portion including a refrigerant inlet, and the second portion including a refrigerant outlet, the baffle plate including a center hole through which the bolt passes, the baffle plate including an extended duct formed during press molding of the baffle plate, the duct extending from the center hole into the second portion of the space, wherein a passage is defined by an inner surface of the extended duct and an outer surface of the bolt through which refrigerant passes from the first portion of the space to the second portion of the space.

2. The discharge muffler according to claim 1 wherein a length of the passage is from 2 to 5 mm.

* * * * *